US005184796A

United States Patent [19]

Maher

[11] Patent Number: 5,184,796

[45] Date of Patent: Feb. 9, 1993

[54] BABY BOTTLE HOLDER

[76] Inventor: Hatholynd C. Maher, 10917 Citreon Ct., North Potomac, Md. 20878

[21] Appl. No.: 696,866

[22] Filed: May 22, 1991

[51] Int. Cl.[5] ..... A61J 9/00

[52] U.S. Cl. ..... 248/104; 248/106

[58] Field of Search ..... 248/102-106, 248/149, 311.2, 311.3, 291

[56] References Cited

U.S. PATENT DOCUMENTS

| | | | |
|---|---|---|---|
| D. 282,969 | 3/1986 | Sukoff . | |
| 485,098 | 10/1892 | Forshew . | |
| 530,435 | 12/1894 | Lowerre | 248/102 |
| 1,617,944 | 2/1927 | Gerstner | 248/102 X |
| 2,134,746 | 11/1938 | Allen | 248/105 |
| 2,344,255 | 3/1944 | Lichter | 248/106 |
| 2,465,015 | 3/1949 | Fisher | 248/102 |
| 2,510,953 | 6/1950 | Brose et al. . | |
| 2,522,647 | 9/1950 | Suich | 248/105 |
| 2,526,121 | 10/1950 | Curry et al. | 248/102 |
| 2,631,288 | 3/1953 | Daust | 248/102 |
| 3,905,571 | 9/1975 | Lombardo | 248/106 |
| 4,405,106 | 9/1983 | Alder | 248/106 X |
| 4,726,551 | 2/1988 | Randall et al. | 248/102 |
| 4,799,636 | 1/1989 | Johnson . | |
| 4,895,327 | 1/1990 | Malone et al. . | |

FOREIGN PATENT DOCUMENTS

| | | | |
|---|---|---|---|
| 589203 | 6/1947 | United Kingdom | 248/104 |

*Primary Examiner*—Karen J. Chotkowski
*Attorney, Agent, or Firm*—William D. Hall

[57] ABSTRACT

An apparatus is disclosed which aids in the feeding of a baby while the baby is placed face-up on a substantially planar feeding surface to various levels of a sitting up position of approximately 45° in angle. The feeding apparatus is a triangular inflatable support system comprising of two straps which encircle the chest under the arms of a baby for securing the entire apparatus to the baby, a strap to secure the bottle to the feeding apparatus and a valve element which inflates and deflates the hollow triangular chamber with air for the purpose of raising or lowering the height of the bottle to control the flow of the liquid into the mouth of the baby for proper feeding. While the primary object of the disclosed invention is for the feeding of a baby, this device can be used by any person who cannot hold a container because of any physical or mental impairment that would limit one's ability to feed oneself.

7 Claims, 2 Drawing Sheets

BABY BOTTLE HOLDER

BACKGROUND

Many attempts have been made in the past to support a baby bottle. Babies usually lack the upper body strength to hold a bottle in the feeding position for extended periods of time. Therefore, the bottle must be held by the parent or other handler. In the prior art, there are numerous examples of bottle holding devices:

| U.S. Pat. No. | Inventor(s) | Issue Date |
|---|---|---|
| 485,098 | Forshew | 10/25/92 |
| 530,435 | Lowerre | 12/04/94 |
| 2,134,746 | Allen | 12/31/36 |
| 2,344,255 | Litchner | 3/14/44 |
| 2,510,953 | Brose et al. | 6/13/50 |
| 2,631,288 | Daust | 3/17/53 |
| 3,905,571 | Lombardo | 9/16/75 |
| DES 282,969 | Sukoff | 03/11/86 |
| 4,726,551 | Randall et al. | 02/23/88 |
| 4,799,636 | Johnson | 01/24/89 |
| 4,895.327 | Malone et al. | 01/23/90 |

The following is a brief description of the above cited prior art.

1) U.S. Pat. No. 530,435 is a baby bottle holder consisting of a filled pillow with a broad base to provide support. A passage in the pillow allows the bottle to be slid into the pillow chamber in a secure manner and maintains a nipple in a position that is readily available to the child. The object of the invention is to reduce the time a mother or nurse must spend attending the child.

2) U.S. Pat. No. 2,134,746 illustrates a baby bottle holder comprising a hollow, flexible structure which is to be weighted by filling the said structure with heavy, loose particles such as sand or rice or in a fluid material. The height of the support is defined by the amount of rice put into the hollow chamber.

3) U.S. Pat. No. 2,344,255 discloses the inflatable aspect for making adjustments in the elevation and angle of the bottle holder. A base structure houses an inflatable bellows which is adjusted by opening a valve and applying air pressure by means of a pumping bulb similar to the bulb of a blood pressure cuff.

4) U.S. Pat. No. 2,510,953 is a dual purpose baby bottle holder. During the first six months of the babies life feeding occurs with the baby laying on its side. A cushion pad with a slight incline acts as a base. A second pad is provided with snap fittings and a conical section for supporting the baby bottle. When the child is older preferences change and holding the bottle is more appealing. The upper snap on section may be removed and supported by a string between the sides of the crib. The baby can then grab the bottle when desired without having to support its weight.

5) U.S. Pat. No. 2,631,288 is a bib/bottle holder combination. The bib has an attachment means for securing the baby. The bottle holder has a wedged shape and elastic strap for securing the bottle. A series of snaps are used to attach the bottle holder to the bib. The inclined wedge allows the milk to flow to the nipple.

6) U.S. Pat. No. 3,905,571 is an inflatable baby bottle holder comprising a plastic diabolo shaped support device. The novelty of the present invention is the diabolo shape. Varying the air pressure permits adjustment of the baby bottle so that it retains in the prior position during the feeding period. See FIG. 2 of the patent to understand the diabolo shape.

7) U.S. Pat. No. DES 282,969 is cited only to illustrate a baby bottle holder design patent. This patent illustrates a support device which maintains the bottle at a prescribed angle.

8) U.S. Pat. No. 4,726,551 is a baby body wrap comprising a pillow, a body wrap, a wedge shaped bottle support block and an elastic strap for securing the bottle to the block. This patent illustrates a prior art means of securing the bottle support mechanism to the infant.

9) U.S. Pat. No. 4,799,636 is an automatic baby bottle positioning holder. It comprises a spherical holder with a hollow portion in which the bottle is press fitted. The base of the sphere has a weighted member which is able to change position by shaking the sphere. In practice the mother will insert the baby then shake the sphere to move the weighted member into the desired position. The sphere is placed on the infants chest. Any motion of the infant may displace the sphere which moves back into the proper position under the influence of the weighted mass.

10) U.S. Pat. No. 4,895,327 is a weighted baby bottle holder with a decorative design. The bottle is secured to a weighted mat which lies across the infants chest. A cover is attached atop the bottle such as an animals head. The novelty of the present invention resides in the means of securing the support mechanism to the child.

SUMMARY OF THE INVENTION

One object of the present invention is to overcome the disadvantages of the prior art. First, their stability is dependant upon the weight placed upon the infant's chest. Second, such devices put unnecessary weight upon the chest of the infant. Third, such devices do not allow for easy bottle adjustment as levels of liquids vary during consumption. Fourth, such devices are designed primarily for infants which are two years of age and under. Sixth, such devices appear cumbersome and expensive to manufacture due to the complexity of design.

It is another object of the present invention to provide a washable cover into which the support system fits for color appeal and variety of texture.

It is a further object of the present invention to provide a feeding apparatus for any age individual who is unable to hold a container with a liuid. The above as well as additional objects, features, and advantages of the invention will become apparent in the following detailed description.

A support for a bottle held by human being, comprises an inflatable body that is triangular in a vertical plane. A plane surface of the body intersects each side of the traingle. One such surface is held against the chest, of the person using the device, by straps that extend around the back and under the arms of the person. A strap from another surface of the tringular body holds the bottle with the nipple of the bottle extending into the mouth of the person using the device.

The degree that the triangular bottle support is inflated will change the angle and position of the bottle. The bottle holder may be adjusted to the particular posture of the body by the amount of the air pressure in the support 12.

As a result the bottle support may hold the bottle in a desired position for any posture of the baby from a prone position to a position in which the baby is sitting upright.

A decorative cover may be placed around the triangular support.

BRIEF DESCRIPTION OF THE DRAWINGS

The novel features believed characteristic of the invention are set forth in the appended claims. The invention itself however, as well as a preferred mode of use, further objects and advantages thereof, will best be understood by reference to the following detailed description of the illustrative embodiment when read in conjunction with the accompanying drawings, wherein:

DETAILED DESCRIPTION OF THE INVENTION

Figure 2:
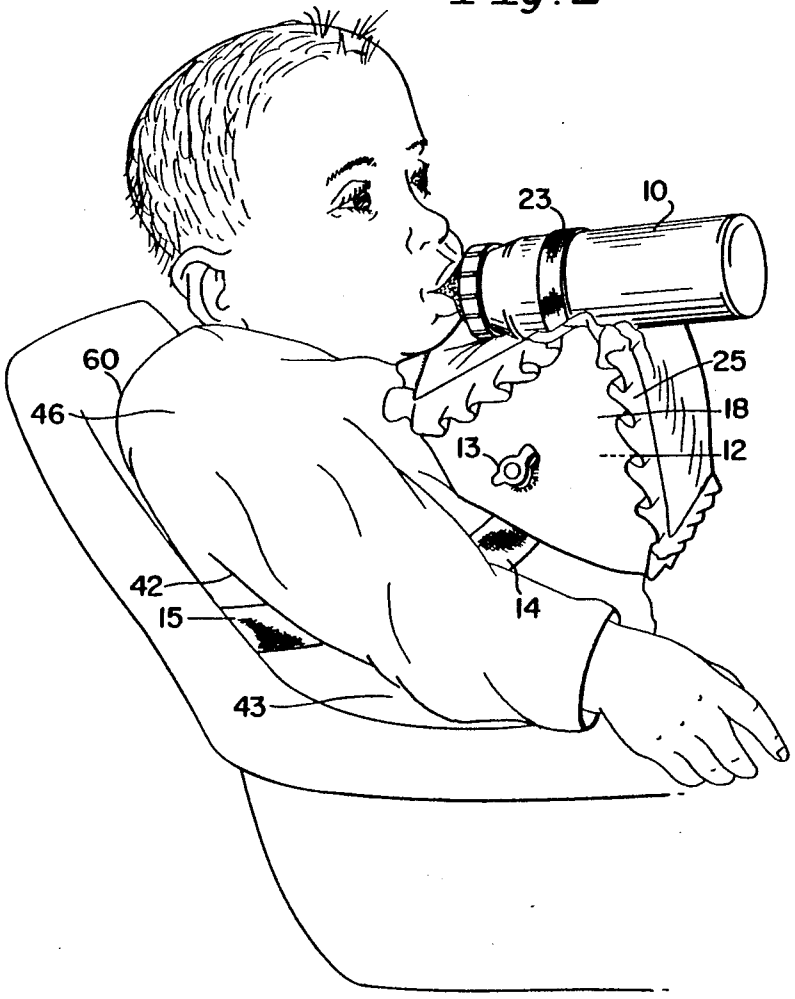
FIG. 2 is a side view of the present invention in use.
Figure 1:
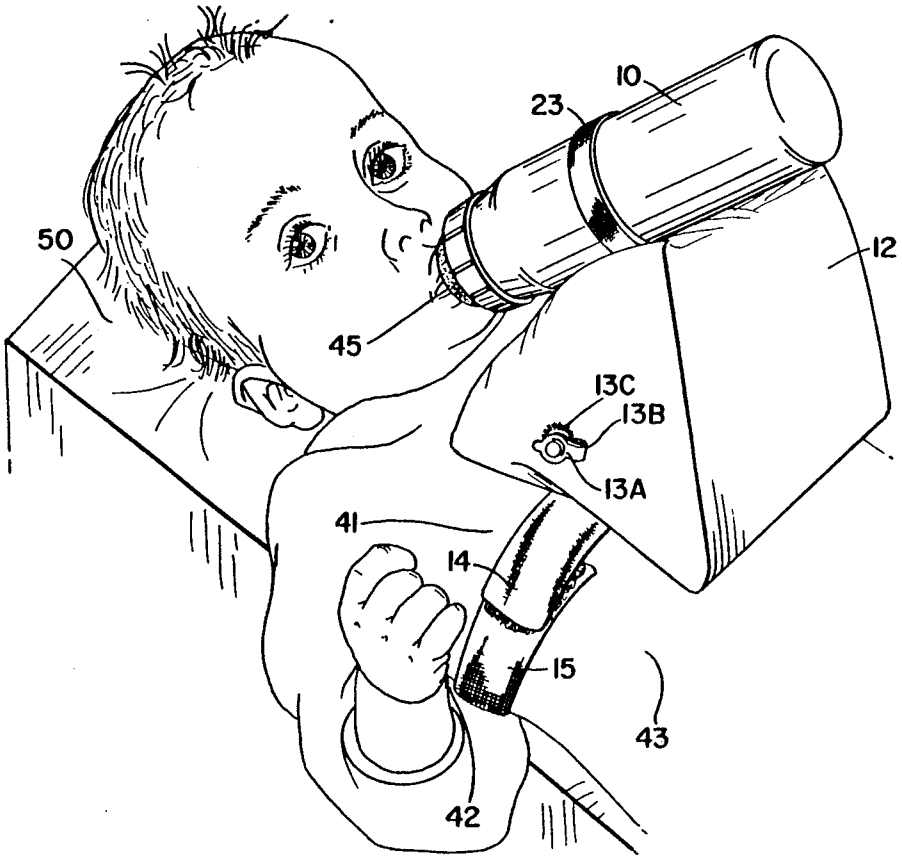
FIG. 1 is a perspective view of the present invention in use.
Figure 3:
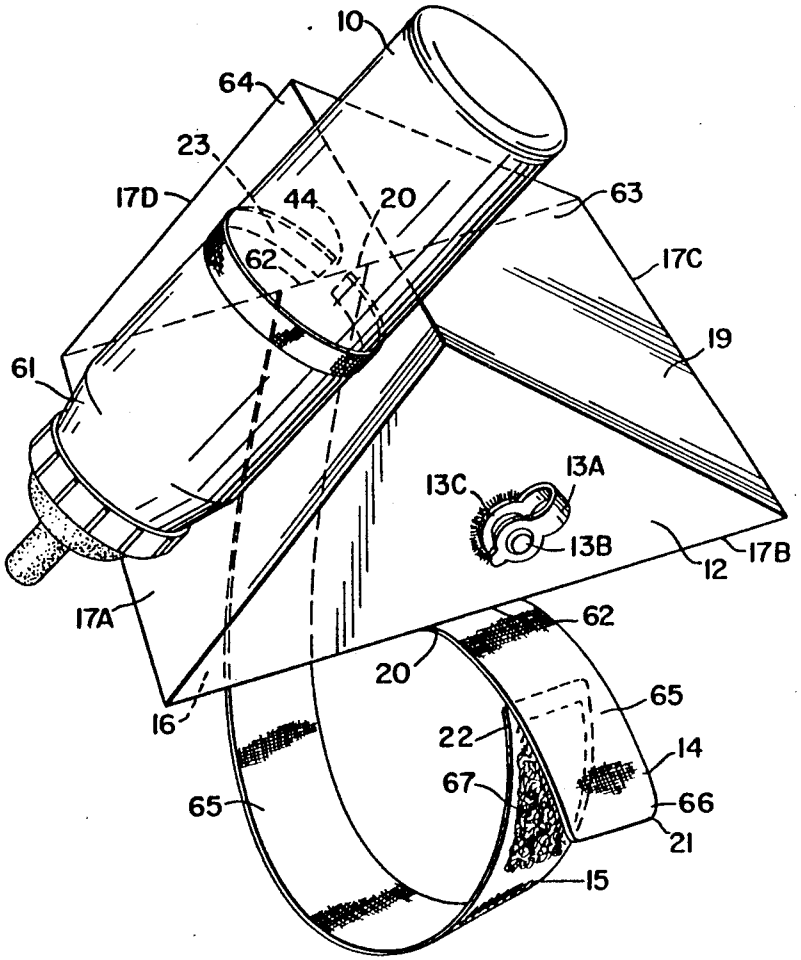
FIG. 3 is a perspective view of the triangular inflatable bottle holder.

With reference to the figures and inparticular to FIG. 3, the triangular bottle support 12, is depicted with a base 16, having sides 17A, 17B, 17C, 17D. Support 12, is formed from a stretchable nonporous elastic material 64, to comprise a hollow air tight container 63. A valve 13C, a valve cap 13B, and valve hinge 13A, are located on one side of the apparatus 12, to provide a means for inflating and deflating the chamber 19, of the bottle support 12, with air which increases or decreases the height of the bottle 10, to regulate the liquid 61, as it is being consumed. Base 16, of the inflatable support 12, rests against the chest of the baby and is positioned there by the straps 14, 15, which go around the back of the baby under the arms of the baby. Straps 14, 15, are made of a washable material 65. Strap 14, is shorter in length than strap 15, each with first ends bonded and equidistant from each other on opposite sides of the base 16. Side seams 20, and 62, connect straps 15, and 14, to the triangular apparatus 12. The second end 66, of strap 14, has a male Velcro strip 21, for the purpose of connecting and disconnecting with a female Velcro strip 67, on the second end 22, of strap 15, which goes completely around the back of the baby and under the arms of the baby, as shown in FIGS. 1 and 2. Referring to FIG. 3, the bottle 10, is held in place with an elastic strap 23, bonded to the upper middle front section 44, of the support 12. This elastic strap 23, secures the bottle 10, and positions the nipple of the bottle in the baby's mouth for proper feeding. The supporting straps 14, 15, and bottle strap 23, together with the inflatable triangular air tight container and bottle support 12, provide a new feeding apparatus and bottle holder that can be used by a baby in a prone position (FIG. 1) or a sitting position (FIG. 2) or in a car seat, swing, etc. (FIG. 2) or in any position between the prone position of FIG. 1 and the sitting position of FIG. 2.

Figure 4:
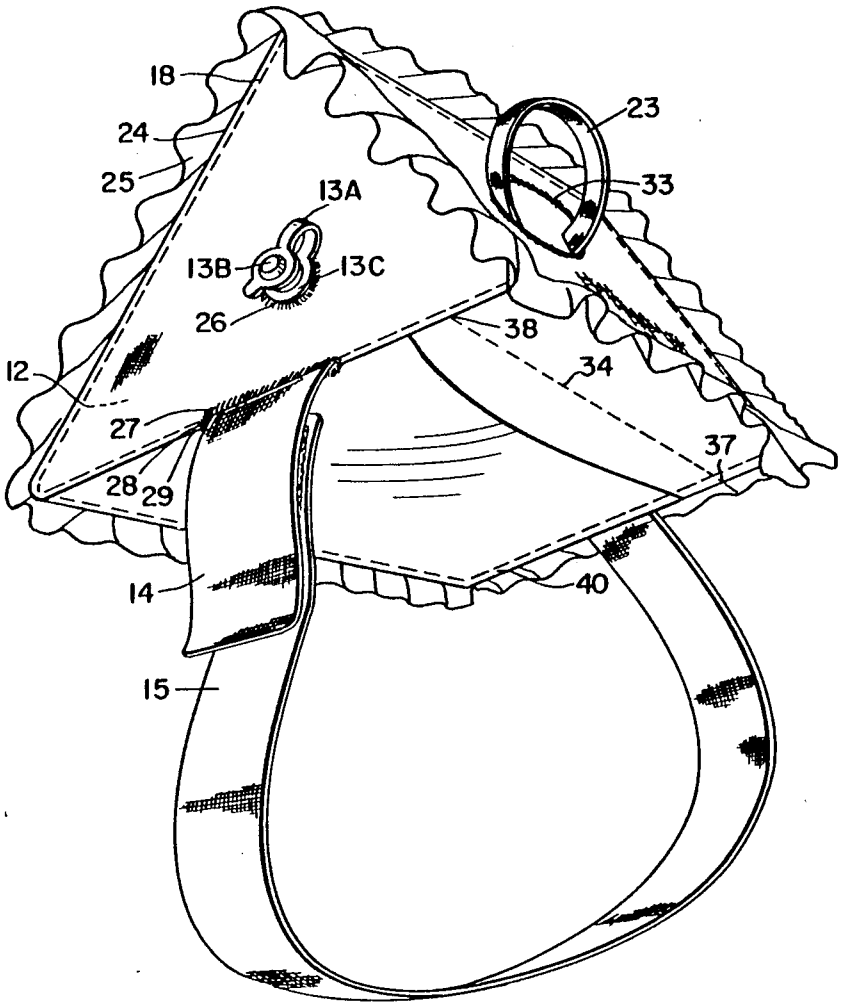
FIG. 4 is perspective view of the removable cover for the triangular inflatable bottle holder.

With reference now to FIG. 4, the removable cover 18, is made of a washable, pliable cloth material 24, with decorations 25, for the purpose of adding variety, color and texture to the inflatable support system 12. Opening 26, of the material 24, allows for the exposure of the valve 13C, the valve cap 13B, and valve hinge 13A, of the inflatable support system 12. Opening 27, between the base seam 28, and side seam 29, of the cover 18, is aligned with strap 14, of the inflatable support apparatus 12, to allow for the exposure of straps 14, 15. Opening 33, at the upper center of the triangular front of the cover 18, aligns with strap 23, of the inflatable feeding apparatus 12, to allow for the exposure of strap 23. Slit 34, in the triangular base 40, of the decorative cover 18; extends from the right base seam 38, to the left seam base 37, for the purpose of allowing decorative cover 18, to be inserted on or removed from the inflatable air tight support apparatus 12. The extension of the material of the cover 18, at the upper portion of base 40, forms a flap 44, to conceal slit 34.

Although the invention has been described with reference to a specific embodiment, this description is not meant to be construed in a limiting sense. Various modifications of the disclosed embodiment as well as alternative embodiments of the invention will become apparent to persons skilled in the art upon reference to the description of the invention. It is therefore contemplated that the appended claims will cover any such modifications or embodiments that fall within the true scope of the invention.

I claim to have invented:

1. A bottle holder, comprising:

a bottle support consisting of an inflatable hollow body and having an air port means for inflating and deflating the body support, said bottle support further having a triangular cross-section in a vertical plane when the hollow body is inflated, and said bottle support having first and second surfaces, means that extends around a human body under the arms, for positioning one of said surfaces against a human chest, means for positioning an elongated bottle adjacent another one of said surfaces, said bottle support, when inflated, being sufficiently flexible to permit a nipple on an elongated bottle to be inserted in the mouth of a human body in any of various positions of the human body from a prone position to a sitting position.

2. A bottle holder as defined in claim 1, in which said means for positioning one of said surfaces against a human chest comprises a strap.

3. A bottle holder as defined in claim 1, in which said means for positioning an elongated bottle comprises a strap.

4. A bottle holder, comprising:

a bottle support consisting of an inflatable hollow body and having an air port means for inflating and deflating the body support, said bottle support having first and second surfaces, holding means that extends around a human body under the arms, for holding one of said surfaces against a human chest, positioning means for positioning an elongated bottle adjacent another one of said surfaces, and said bottle support, when inflated, extending outwardly and upwardly away from said holding means to permit an elongated bottle to be positioned at a level higher than the mouth of a human body when that body is in a sitting position, and being sufficiently flexible to permit a nipple on the elongated bottle to slant downwardly into the mouth of a human body in any of various positions of the human body from a prone position to a sitting position,

5. A bottle holder as defined in claim 4, in which said holding means is a strap that extends around the chest of a human body and under the arms of that human body, said strap extending around the human body in a generally horizontal plane when the human body is in a sitting position, said inflatable hollow body moving in a plane generally transverse to said generally horizontal plane while it is being inflated and thereby comprising means for positioning the elongated bottle at a higher level than the mouth of the human body.

6. A bottle holder as defined in claim 4, in which said surface that is against a human chest expands when the inflatable hollow body is inflated.

7. A bottle holder, comprising:

a bottle support having a triangular cross-section in a vertical plane, said bottle support having first and second surfaces, means, comprising a strap that extends around a human body under the arms, for positioning one of said surfaces against a human chest, means, including a strap, for positioning an elongated bottle adjacent another one of said surfaces, said bottle support being hollow and having an air port for allowing the bottle support to be inflated and deflated, and a decorative cloth cover for said bottle support, said cloth covering said bottle support and defining a slit enabling the cloth cover to be inserted around, and removed from, said bottle support, said bottle support, when inflated, being sufficiently flexible to permit a nipple on the elongated bottle to be inserted in the mouth of a human body in any of various positions of the human body from a prone position to a sitting position.

* * * * *